United States Patent [19]

Bauer

[11] 4,253,653

[45] Mar. 3, 1981

[54] APPARATUS FOR SINGULARIZING STACKED SHEETS OF RADIATION-SENSITIVE MATERIAL OR THE LIKE

[75] Inventor: Walter Bauer, Munich, Fed. Rep. of Germany

[73] Assignee: AGFA-Gevaert, A.G., Leverkusen, Fed. Rep. of Germany

[21] Appl. No.: 26,682

[22] Filed: Apr. 3, 1979

[30] Foreign Application Priority Data

Apr. 7, 1978 [DE] Fed. Rep. of Germany ..... 2815163

[51] Int. Cl.[3] ..... B65H 3/24; B65H 1/24

[52] U.S. Cl. ..... 271/22; 221/227; 221/231; 271/24; 271/225

[58] Field of Search ..... 271/22, 21, 23, 24, 271/25, 19, 225, 118, 119, 126, 109, 18; 221/231, 227, 43, 42; 414/123, 129

[56] References Cited

U.S. PATENT DOCUMENTS

| | | | |
|---|---|---|---|
| 234,469 | 11/1880 | Griffith et al. | 271/22 |
| 825,264 | 7/1906 | Dick | 271/22 |
| 1,054,637 | 2/1913 | Dick | 271/22 |
| 1,703,594 | 2/1929 | Pratt | 271/19 UX |
| 3,126,122 | 3/1964 | Sacre | 221/43 X |
| 3,372,923 | 3/1968 | Watson et al. | 271/23 |
| 3,645,527 | 2/1972 | Gates | 271/21 X |
| 4,078,672 | 3/1978 | Crepaldi et al. | 271/22 X |

FOREIGN PATENT DOCUMENTS

| | | | |
|---|---|---|---|
| 2349097 | 4/1975 | Fed. Rep. of Germany | 271/119 |
| 2724388 | 12/1978 | Fed. Rep. of Germany | 414/129 |
| 877329 | 9/1961 | United Kingdom | 271/109 |

*Primary Examiner*—Bruce H. Stoner, Jr.
*Attorney, Agent, or Firm*—Peter K. Kontler

[57] ABSTRACT

The outermost sheet of a stack of overlapping sheets in a magazine is partially separated from the neighboring sheet of the stack by the peripheral projection of a singularizing roller which is adjacent to the rear edge face of the outermost sheet. The projection engages and moves the rear edge face forwardly while the outermost sheet is biased against an abutment in the region of its front edge face. The bias upon the outermost sheet is relaxed or terminated when the rear portion of the outermost sheet is flexed away from the neighboring sheet so that the outermost sheet can be withdrawn from the magazine, either forwardly or rearwardly, by advancing rolls which are installed in close proximity of the singularizing roller, in the interior of the roller, or close to the front edge face of the outermost sheet of the stack. The bias upon the outermost sheet is terminated in automatic response to rotation of the singularizing roller through an angle which suffices to insure separation of the rear portion of such outermost sheet from the neighboring sheet. If the stack is held in upright position, the outermost sheet can be allowed to leave the magazine by gravity by descending through a slot in the singularizing roller. If the slot constitutes a pocket, the singularizing roller can be used to reorient successive outermost sheets and to deposit the reoriented sheets onto a belt conveyor.

18 Claims, 8 Drawing Figures

1
2
2a
2b
2b'
2c
2d
2e
3
4
4a
4b
5
6
7
8
9
10
11
12
13
14
15
16
17
17'
17E
17F
111
108
109
A
B 8
8a
8b
8c
8d
8e
8f
d
≈ 60°

E
72
73
17F
71a
71
202b
6
14
11
279
207
5
17
78f
78
17'
78a
78b
A
202

APPARATUS FOR SINGULARIZING STACKED SHEETS OF RADIATION-SENSITIVE MATERIAL OR THE LIKE

BACKGROUND OF THE INVENTION

The present invention relates to apparatus for removing successive outermost sheets from a stack of overlapping sheets, especially for singularizing sheets of radiation-sensitive material prior to delivery to an exposing or other station. Still more particularly, the invention relates to apparatus which can remove successive discrete sheets from a stack by means of a rotary singularizing device.

German Auslegeschrift No. 2,349,097 discloses a singularizing apparatus wherein a rotary device has projections serving to engage the trailing edge of the lowermost sheet of a stack in a magazine and to advance the sheet lengthwise toward and through a slit-shaped opening which is in register with the leading edge of the lowermost sheet. The width of the opening is such that it can permit the passage of a single sheet at a time. A drawback of such apparatus is that particles of dust or other solid matter between the lowermost and next-to-the-lowermost sheets are likely to scratch the surface of one or both sheets during expulsion of the lowermost sheet. The likelihood of scratching is especially pronounced if the height of the stack above the lowermost sheet is substantial and if that surface of one or both lowermost sheets which contacts the other of these sheets is coated with a sensitive emulsion. In fact, mere sliding of the lowermost sheet with respect to the adjacent sheet is likely to cause damage to films of photosensitive material.

OBJECTS AND SUMMARY OF THE INVENTION

An object of the invention is to provide a novel and improved singularizing apparatus which can remove successive outermost sheets of a stack of overlapping sheets in such a way that frictional engagement of the sheet which is in the process of being removed with the neighboring sheet is negligible or zero.

Another object of the invention is to provide a singularizing apparatus which is especially suited for removal of outermost sheets which are provided with films of photosensitive material of the type that is readily scratched as a result of frictional engagement with an adjacent sheet and/or with a particle of dust or other solid particulate material.

A further object of the invention is to provide an apparatus which can remove sheets from upright, horizontal or otherwise inclined stacks and is constructed and assembled in such a way that it invariably removes a single sheet at a time.

Another object of the invention is to provide an apparatus which can change the orientation of sheets during withdrawal from the stack and which can move the withdrawn sheets forwardly or backwards.

An additional object of the invention is to provide a relatively simple and compact apparatus which can remove successive sheets from a stack of superimposed sheets while the stack is shielded from light.

Another object of the invention is to provide an apparatus which can be used in existing machines or laboratories for the exposure and/or other treatment of sheets consisting of or embodying layers of radiation-sensitive material.

A further object of the invention is to provide that apparatus with novel and improved means for intermittently reducing the pressure between neighboring sheets of a stack of superimposed or overlapping sheets.

The apparatus of the present invention serves to remove successive outermost sheets of a stack of overlapping sheets each of which has a front and a rear edge face and wherein the outermost sheet of the stack has an outer side facing away from the neighboring (next-to-the-outermost) sheet of the stack. The apparatus comprises an abutment for that part of the outer side of the outermost sheet which is adjacent to one edge face of the outermost sheet (e.g., to the front edge face), a spring-biased pressure plate or analogous means for biasing the stack toward the abutment so that the outer side of the outermost sheet normally bears against the abutment (the abutment may constitute one wall of a magazine or another suitable receptacle for the stack of sheets and for the biasing means) and the outermost sheet is located in a predetermined plane, a rotary singularizing member (e.g., a roller whose axis is parallel to the edge faces of the outermost sheet in the aforementioned plane) having at least one projection which is movable along an arcuate path having a first section into which the other edge face of the outermost sheet in the aforementioned plane extends and a second section which is nearer to the abutment than the first section, a friction wheel or other suitable means for rotating the singularizing member in a direction to move the projection along the first path section into engagement with the other edge face of the outermost sheet in the aforementioned plane and thereupon along the second path section to thereby flex away from the neighboring sheet that portion of the outermost sheet which is disposed between the projection and the abutment, and a rotary crank arm or other suitable means for retracting the biasing means in a direction away from the abutment (preferably at right angles to the aforementioned plane) to thereby relax the pressure between the aforementioned part of the outer side of the outermost sheet and the abutment in flexed condition of the sheet portion between the abutment and the projection so that the outermost sheet can be removed from the stack without any or with negligible friction between the outermost sheet on the one hand and the neighboring sheet and the abutment on the other hand.

If the stack is confined in a magazine or another suitable receptacle, the latter has an opening intermediate the abutment and the singularizing member to allow for outward flexing or bulging of the sheet portion which is adjacent to the other edge face of the outermost sheet when the projection moves along the second section of its arcuate path. The distance between the abutment and the second section of the arcuate path at least equals but preferably exceeds the diameter of the singularizing member, and the width of the opening (as considered in the longitudinal direction of edge portions of the outermost sheet) at least equals but preferably exceeds the width of the stack.

The apparatus preferably further comprises a retractible or stationary stop for the one edge portion of the outermost sheet which is located in the aforementioned plane. The means for retracting the biasing means while the outermost sheet is flexed by the projection of the singularizing member preferably comprises a transmission which rotates a crank arm in synchronism with rotary movement of the singularizing member to thus insure that retraction of the biasing means takes place at an appropriate time, namely, when the outermost sheet is flexed sufficiently in order to separate if from the neighboring sheet and when the other edge face of the flexed outermost sheet is moved into the range of advancing rolls which are adjacent to the singularizing member. Alternatively, the aforementioned stop at the one edge face of the outermost sheet can be withdrawn when the outermost sheet is flexed whereby the outermost sheet is propelled forwardly as a result of its tendency to reassume the original (flat) condition and its one edge face is thereby advanced in a direction away from the singularizing member and into the nip of two advancing rolls which complete the removal of the outermost sheet from the stack.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
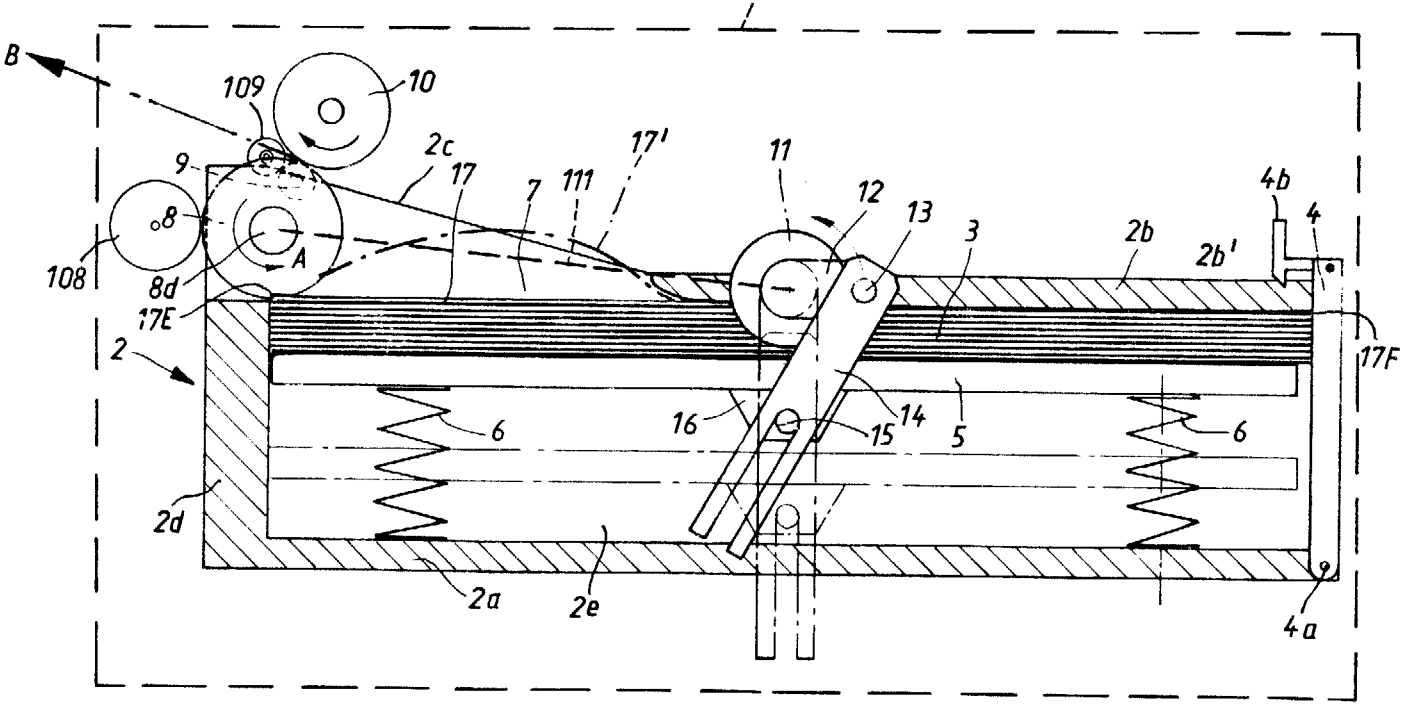
FIG. 1 is a longitudinal sectional view of an apparatus which embodies one form of the invention.

Referring first to FIG. 1, there is shown a singularizing apparatus which comprises a support or frame 1 (indicated by broken lines) for a receptacle or magazine 2 serving to store and confine a stack 3 of discrete superimposed substantially horizontal sheets 17. For example, each sheet 17 may constitute a polyethylene foil of the type normally used for the making of latent images in the ionography imaging chamber of a radiographic apparatus (e.g., a mammograph). Alternatively, each sheet 17 may constitute a foil of the type used in X-ray machines.

The magazine 2 comprises a front side wall 4 which is pivoted to a bottom wall 2*a*, as at 4*a*, and is attached to a top wall 2*b* by a pivotable catch 4*b*. When the catch 4*b* *is disengaged from a detent notch 2b'* in the top wall 2*b*, the front side wall 4 can be pivoted in a clockwise direction, as viewed in FIG. 1, so as to allow for insertion of a fresh stack 3. The wall 4 also serves as an abutment or stop for front edge faces 17F of the stacked sheets 17.

The lowermost sheet 17 of the stack 3 rests on a reciprocable pressure plate or platform 5 which biases the stack upwardly toward the top wall 2*b* and is urged in such direction by helical springs 6 or like resilient or elastic elements reacting against the upper side of the bottom wall 2*a* of the magazine 2. This insures that the right-hand part of the upper or outer side of the uppermost or outermost sheet 17 of the stack 3 abuts against the underside of the top wall 2*b*. This top wall constitutes an abutment which overlies only a portion of the topmost sheet, namely, that (right-hand) portion which is adajcent to the mobile front side wall 4. An opening 7 is defined between the top wall 2*b* and a rear side wall 2*d* of the magazine 2 and is at least as wide as the stack 3 (as measured in the longitudinal direction of the front and rear edge faces 17E, 17F of the sheets 17 and at right angles to the plane of FIG. 1) so that it exposes a substantial part (nearly one-half) of the outermost sheet 17.

The opening 7 serves to enable a rotary singularizing member 8 (hereinafter called roller for short) to contact the upper or outer side of the outermost sheet 17. A shaft 8*d* for the roller 8 is mounted in two lateral bearing plates 2*c* (one shown) of the receptacle or magazine 2 in such a way that the upper side of the outermost sheet 17 of the stack 3 is tangential to the cylindrical portion of the periphery of the roller 8. The axis of the shaft 8*d* is parallel to and coplanar with the rear edge faces 17E of the sheets 17 in the magazine 2.

The periphery of the roller 8 comprises a cylindrical portion 8*e* and at least one flat 8*a* (see FIG. 2) which is adjacent to a recess or notch 8*b* extending in parallelism with the shaft 8*d* (i.e., transversely of the stack 3, as considered at right angles to the plane of FIG. 1) and all the way between the axial ends of the roller 8. The reference character d in FIG. 2 denotes maximum thickness of that portion of the roller 8 which has been removed in order to form the flat 8*a*. Such thickness at most matches and can be less than the thickness of a sheet 17. This thickness d equals r minus $r_a$ (see FIG. 3) wherein r is the radius of the roller 8 and $r_a$ is the distance between the axis of the roller 8 (i.e., the axis of the shaft 8*d*) and a flat 8*a*. That internal surface or shoulder of the roller 8 which flanks the recess 8*b* opposite the flat 8*a* is shown at 8*c*. The angle between the planes of the flat 8*a* and of the surface 8*c* is approximately 60 degrees. A portion 8*f* of the roller 8 at the outer end of the surface 8*c* constitutes a projection or tooth which extends radially outwardly beyond the flat 8*a*.

The axial length of the roller 8 is less than the width of the stack 3, and this roller is flanked by a pair of lower advancing rolls 9 which are journalled in the respective bearing plates 2*c* (FIG. 1 merely shows that roll 9 which is located behind the roller 8). The distance between the rolls 9 is somewhat less than the width of a sheet 17, i.e., these rolls can engage the undersides of the corresponding longitudinal marginal portions of a sheet 17 whose left-hand portion is moved beyond the broken-line position 17' of FIG. 1. Each of the lower rolls 9 cooperates with an upper advancing roll 10 which is mounted in the frame 1 to move a sheet 17 in the direction of an arrow B. The magazine 2 is insertable into and removable from the frame 1; when the magazine 2 is properly inserted, the lower rolls 9 are driven and cooperate with the upper roll 10 to withdraw the uppermost sheet 17 from the space between the abutment or top wall 2b and the neighboring (next-to-the-uppermost) sheet 17 and to advance the withdrawn sheet 17 in the direction of the arrow B on to a station where the withdrawn sheet 17 is put to use, e.g., into the interelectrode gap of an ionography imaging chamber of the type disclosed in commonly owned U.S. Pat. No. 4,021,668 granted May 3, 1977 to Josef Pfeifer et al.

A wheel 11 which is mounted on one of the lateral side walls 2e or on the top wall 2b of the magazine 2 is connected with a crank arm 12 which is coupled to the upper end portion of a swingable lever 14 by a horizontal pin 13. The prongs of the bifurcated lower end portion of the lever 14 straddle a pin 15 which is attached to a lug 16 extending downwardly from the pressure plate 5. When the wheel 11 is rotated in the direction of arrow, the lever 14 moves between the solid-line and phantom-line positions of FIG. 1 to thereby intermittently lower the pressure plate 5 against the opposition of the springs 6. The means for synchronizing the angular movements of the roller 8 and of the wheel 11 comprises a belt or chain transmission 111 (indicated in FIG. 1 by a heavy broken line) so that the pressure plate 5 is moved below the solid-line (upper end) position of FIG. 1 when the trailing end of the left-hand portion of the uppermost wheet 17 (in the position 17') enters the nip of the advancing rolls 9 and 10.

Figure 2:
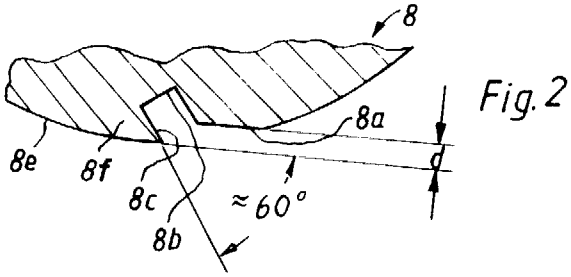
FIG. 2 is an enlarged sectional view of a portion of the rotary sheet withdrawing or singularizing member in the apparatus of FIG. 1.

The operation of the singularizing apparatus of FIGS. 1 and 2 is as follows:

The magazine 2 is loaded in the aforementioned manner so that it contains a stack 3 of overlapping sheets 17. The front side wall 4 is then returned to the illustrated position and the magazine 2 is inserted into the frame 1. This places the roller 8 and the advancing rolls 9 into torque receiving engagement with suitable drive means which are installed in the frame 1. FIG. 1 merely shows a friction wheel 108 which engages the roller 8 and a friction wheel 109 which engages the illustrated advancing roll 9. Alternatively, the friction wheels can be replaced by suitable gear trains whose output elements mate with gears on the roller 8 and on the advancing roll 9 when the magazine 2 is properly inserted into the frame 1. Still further, the shafts of the roller 8 and of the advancing rolls 9 can carry driven elements of clutches whose driving elements are installed in the frame 1 and begin to transmit torque to the parts 8 and 9 as soon as the magazine 2 is moved to the illustrated position. All that counts is to provide means for rotating the mobile components of the apparatus when the magazine 2 is properly inserted into the frame 1. The roller 8 transmits torque (via transmission 111) to the wheel 11 of the means for moving the pressure plate 5 against the opposition of the springs 6.

In the starting position of the roller 8 and of the wheel 11, the springs 6 are free to maintain the pressure plate 5 in the solid-line position of FIG. 1, i.e., the right-hand part of the upper side of the uppermost sheet 17 of the stack 3 is maintained in contact with the underside of the abutment or top wall 2b but the left-hand part of such upper side is accessible in the region of the opening 7. Furthermore, the leftmost part of the upper side of the uppermost sheet 17 abuts against the cylindrical portions 8e of the periphery of the roller 8. The roller 8 is thereupon caused to rotate in the direction of an arrow A to move its flat 8a toward the rear (left-hand) edge face 17E of the uppermost sheet 17. The flat 8a slides along the leftmost part of the upper side of the uppermost sheet 17 and the latter begins to buckle (i.e., it begins to undergo deformation in a direction to assume the phantom-line position 17') when its rear edge face 17E is engaged by the outermost part of the internal surface or shoulder 8c of the oncoming notch 8b, i.e., by the projection 8f. The pressure plate 5 is sufficiently close to the opening 7 to insure that the rear edge face 17E of the uppermost sheet 17 is invariably engaged by the surface or shoulder 8c, i.e., that such rear edge face invariably enters the notch 8b. As the roller 8 continues to rotate in the direction of the arrow A, the rear edge face 17E of the uppermost sheet 17 is entrained by the projection 8f and is moved toward the front side wall 4 with progressively increasing bulging or flexing or the uppermost sheet in the region of the opening 7. The wall 4 is located in the path of the front edge face 17F and insures that the uppermost sheet 17 cannot slide forwardly. The top wall 2b confines the bulge to the left-hand portion 17' of the uppermost sheet 17. The median part of the left-hand portion 17 of the uppermost sheet 17 bulges upwardly through and beyond the opening 7. Such bulging of the uppermost sheet 17 invariably insures that the sheet is separated from the sheet therebelow, e.g., that the bulging or flexing overcomes adhesion between such sheets as a result of electrostatic charges or for other reasons. Even if the next-following sheet 17 is lifted slightly off the sheet therebelow, it returns to a position of parallelism with the pressure plate 5 in response to progressive bulging of the left-hand portion of the uppermost sheet 17. Such return movement of the next-to-the-uppermost sheet 17 to the illustrated position is due to innate stiffness of its material and also because the projection 8f at the outer end of the surface or shoulder 8c of the roller 8 engages only the rear edge face 17E of the uppermost sheet 17, i.e., the next-to-the-uppermost (neighboring) sheet is not positively lifted off the sheet therebelow but is partially lifted (if at all) only as a result of adherence to the underside of the uppermost sheet.

The rear edge portion of the uppermost sheet 17 is confined in the notch 8b and is transported toward the nip of the advancing rolls 9, 10. When the notch 8b advances toward and approaches such nip, the bulge of the uppermost sheet 17 decreases as a result of stiffness of the material of the sheet 17. The notch 8b then moves away from the rear edge portion of the outermost sheet 17 in response to further rotation of the roller 8, and the rear edge portion enters the nip of the rotating rolls 9, 10 to be positively advanced in the direction of the arrow B.

The operative connection or transmission 111 between the roller 8 and wheel 11 operates in such a way that the crank arm 12 causes the lever 14 to push the pressure plate 5 downwardly not later than when the leading edge portion of the uppermost sheet 17 enters the nip of the advancing rolls 9 and 10. This insures that the rolls 9 and 10 can withdraw the uppermost sheet 17 from the magazine 2 without any or with negligible frictional engagement between the right-hand portion of such sheet and the sheet therebelow and/or the underside of the top wall 5. The lever 14 maintains the pressure plate 5 below the solid-line position of FIG. 1 until the withdrawal of the uppermost sheet 17 is completed, i.e., the pressure plate 5 reassumes such solid-line position not earlier than when the front edge portion of the uppermost sheet 17 is already located to the left of the top wall 2b. This positively prevents or greatly reduces the likelihood of damage to (e.g., scratching of)

the underside of the uppermost sheet 17 or the upper side of the next-to-the-lowermost sheet, even if such sheets confine one or more particles of dust or other foreign matter which would be likely to deface the emulsion-coated side of the uppermost sheet 17 and/or of the sheet therebelow.

The pressure plate 5 is free to reassume the solid-line position of FIG. 1 (under the action of springs 6) not later than when the flat 8*a* of the roller 8 reaches the left-hand edge face 17E of the fresh uppermost sheet 17, i.e., the apparatus is ready to remove fresh uppermost sheets with a minimum of delay between successive singularizing cycles.

The parts 11 to 16 constitute but one form of means for moving the pressure plate or biasing means 5 in synchronism with angular movements of the singularizing roller 8. For example, the wheel 11 can be driven by a rotary electromagnet (not shown) which is energized and deenergized in certain angular positions of the roller 8. To this end, the roller 8 (or another part which rotates with the roller 8) can carry one or more magnets which cooperate with a proximity detector in the circuit of the rotary electromagnet. Furthermore, the flat 8*a*, the projection 8*f* and the notch 8*b* of the roller 8 can be replaced by other suitable means which causes the left-hand portion of the uppermost sheet 17 to bulge in response to rotation of the roller in the direction of the arrow A. For example, the periphery of the roller 8 can be formed with a helix, or the periphery of the entire roller 8 can form a helix with one or more axially extending shoulders which perform the function of the surface 8*c*. Reference may be had to the aforementioned German Auslegeschrift No. 2,349,097. When a smaller-diameter portion of the helix advances beyond the trailing edge portion of the uppermost sheet 17, such edge portion is engaged by a projection between the smaller-diameter portion and the next-following larger-diameter portion of the helix to thereby cause the left-hand portion of the uppermost sheet 17 to bulge in the same way as shown at 17'.

By changing the effective width L (see FIG. 3) of the opening 7 between the top wall 2*b* and roller 8, by changing the position of the roller 8 with respect to the top wall 2*b* and/or by replacing the roller 8 by a larger- or smaller-diameter roller, one can change the radius of curvature of the bulging portion 17' of the outermost sheet 17 of the stack 3 in the magazine 2. This can become necessary in order to account for stiffness of the material of the sheets (i.e., the tension which develops in the flexed outermost sheet) and/or to take into consideration the magnitude of forces which attract the outermost sheet of the stack to the neighboring sheet. If the adhesive forces between neighboring sheets are pronounced, the width L of the opening 7 is preferably reduced and/or the roller 8 is replaced by a larger-diameter roller. This invariably insures that the next-to-the-outermost sheet becomes separated from the outermost sheet before the latter enters the nip of the advancing rolls 9 and 10.

Figure 3:
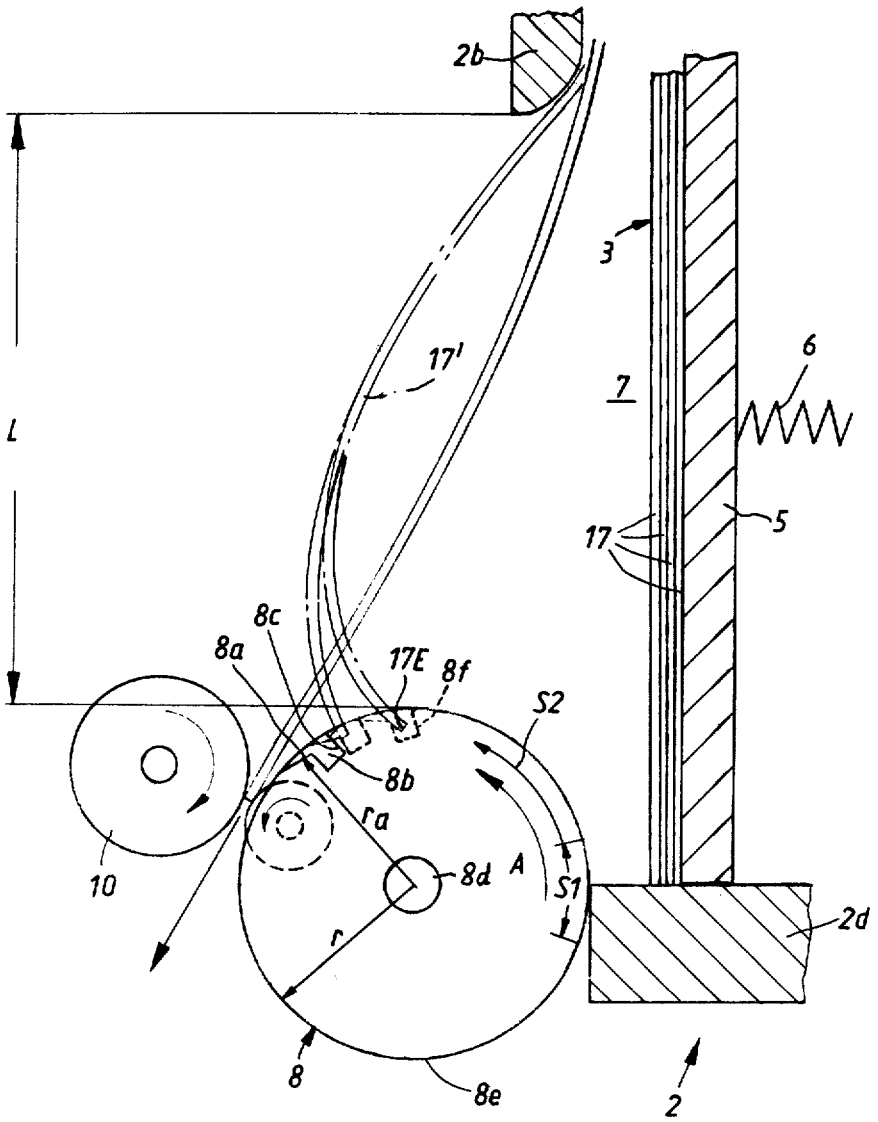
FIG. 3 is an enlarged view of a detail in the apparatus of FIG. 1.

FIG. 3 further shows that the frame 1 can be installed in such position that the properly inserted magazine 2 maintains the sheets 17 of the stack 3 in a vertical plane. In fact, the apparatus of FIG. 1 can be operated properly irrespective of the inclination of sheets 17 which form the stack 3.

FIG. 3 shows that the projection 8*f* of the singularizing roller 8 travels along an arcuate path while the roller 8 rotates in the direction of the arrow A. The lower edge face 17E of the outermost sheet 17 extends into a first section S1 of such arcuate path of the projection 8*f*. The projection 8*f* thereupon advances along a second section S2 of its arcuate path and causes the lower portion of the outermost sheet 17 to flex outwardly and away from the neighboring sheet of the stack 3 whereby the lower portion of the outermost sheet assumes the position 17'. The section S2 is nearer to the abutment or top wall 2*b* than the section S1.

The length of the opening 7, as considered in a direction from the wall 2*d* toward the wall 4 (i.e., the distance between the wall or abutment 2*b* and the roller 8) is not less than and preferably exceeds the diameter of the roller 8. This provides room for adequate flexing of the lower portion of the outermost sheet 17. The width of such opening, as measured at right angles to the plane of FIG. 1 or 3 (i.e., in the longitudinal direction of the front and rear edge faces 17F and 17E of the outermost sheet 17), exceeds the width of the stack 3. This insures that the lateral side walls 2*e* of the magazine or receptacle 2 cannot interfere with flexing of the lower portion of the outermost sheet 17 and that such sheet can be readily withdrawn from the magazine 2 by the advancing rolls 9 and 10 as soon as its rear or lower edge portion enters the nip of the advancing rolls.

FIG. 1 shows that, when the pressure plate or biasing means 5 is free to assume its solid-line position, the outermost or uppermost sheet 17 of the stack 3 is located in a predetermined plane in which the rear edge face 17E of such sheet extends into the section S1 of the arcuate path for the projection 8*f* and the right-hand part of the outer side of the outermost sheet 17 abuts against the underside or inner side of the abutment or wall 2*b*. At the same time, the wall or stop 4 is located in front of the front edge face 17F of the outermost sheet 17.

As the projection 8*f* travels along the section S2 of its arcuate path, it cooperates with the abutment or wall 2*b* and pressure plate or biasing means 5 to reduce the distance between the edge faces 17E, 17F of the outermost sheet 17 whereby the outermost sheet is compelled to buckle into the opening 7 and to thus become partially separated from the neighboring (next-to-the-outermost) sheet. The stop or front side wall 4 constitutes a safety feature which insures that the outermost sheet 17 cannot move forwardly while the projection 8*f* advances along the path section S2. As stated above, the stiffness of sheets 17 suffices to insure that the next-to-the-outermost sheet becomes separated from the outermost sheet when the rear portion 17 of the outermost sheet 17 is flexed into the opening 7. Thus, the rear portion of the next-to-the-outermost sheet becomes separated from the rear portion 17 of the outermost sheet 17 not later than when the pressure plate 5 is retracted in a direction away from the abutment or top wall 2*b* through the medium of the transmission 111, wheel 11, crank arm 12 and means 13–16 which couples the crank arm 12 to the pressure plate 5. Complete separation of the rear portion 17 of the outermost sheet 17 from the next-to-the-outermost (neighboring) sheet of the stack 3 is invariably completed when the recess or notch 8*b* is located at that side of the roller 8 which faces away from the pressure plate 5, i.e., when the edge face 17E of the lower portion 17' of the outermost sheet 17 (as viewed in FIG. 3) is located at or to the left of the twelve o'clock position. The portion 17' leaves the recess or notch 8*b* and its lowermost part enters the nip of the advancing rolls 9, 10 in automatic response to further movement of the projection 8*f* along the path section S2.

Figure 4:
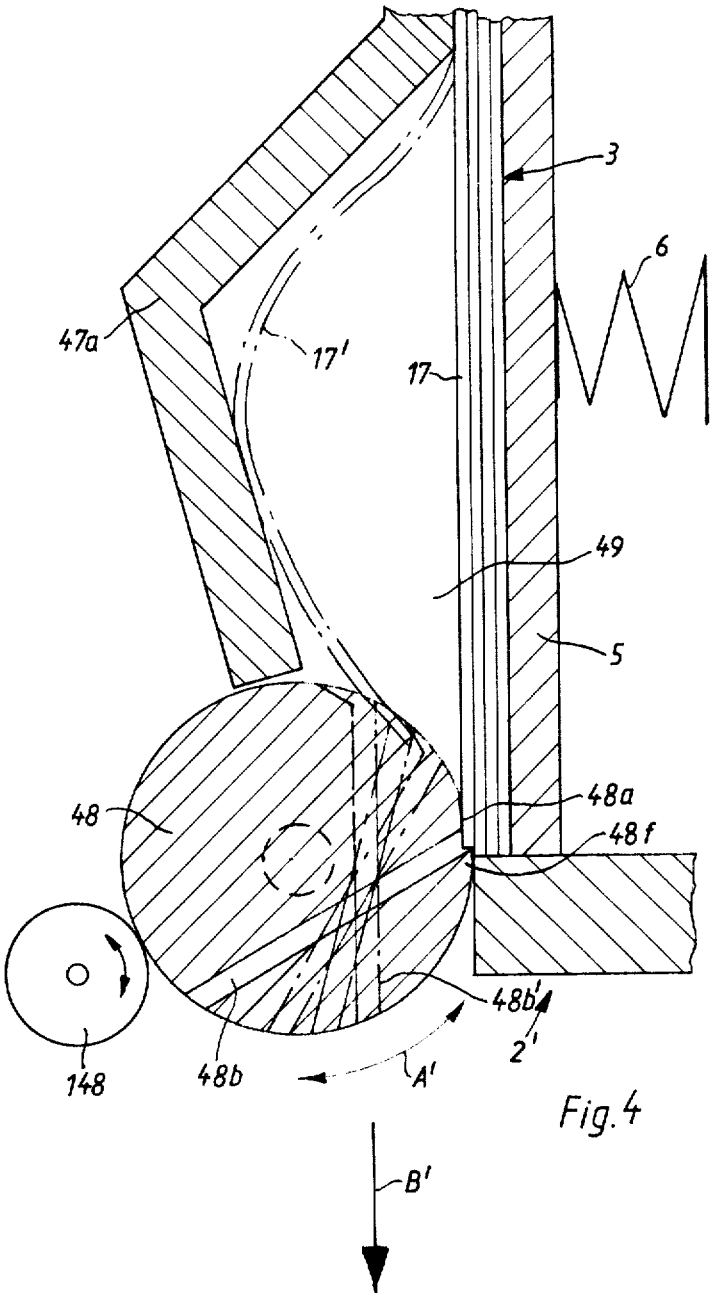
FIG. 4 is a similar fragmentary sectional view of a second singularizing apparatus.

FIG. 4 illustrates a portion of a modified apparatus which is especially suited for withdrawal of sheets 17 while the sheets are maintained in a vertical or nearly vertical plane (i.e., in upright position of the stack 3) so that, when the stack 3 is released by the pressure plate 5, the outermost sheet 17 can leave the magazine 2' by gravity. This obviates (at least in some instances) the need for the advancing rolls 9 and 10 of FIG. 1 and for the drive means which transmits torque to such advancing rolls.

The length of the singularizing roller 48 of FIG. 4 (this roller replaces the roller 8 of FIGS. 1 to 3) exceeds the width of the stack 3 (as measured at right angles to the plane of FIG. 4), and the roller 48 is formed with a transverse recess 48*b* which is a through slot and whose length also exceeds the width of the stack 3. In contrast to the roller 8 which is rotated in a single direction (arrow A in FIG. 1), the roller 48 of FIG. 4 is rotated back and forth (see the arrow A') by a friction wheel 148 or the like between two spaced apart end positions in which the slot 48*b* respectively assumes the solid-line (inclined) position and the vertical position 48*b'* shown by phantom lines. In the solid-line position, the slot 48*b* receives the lower edge portion of the outermost sheet 17, and the lower portion of the outermost sheet begins to bulge toward the position 17' in response to counterclockwise rotation of the roller 48. When the slot 48*b* reaches the phantom-line position 48*b'*, it is substantially parallel with the pressure plate 5 and the latter is then withdrawn against the opposition of the springs 6 (one shown in FIG. 4) by a mechanism which can be identical with the mechanism 111, 11-16 of FIG. 1. Therefore, the outermost sheet 17 is free to descend by gravity and to advance (arrow B') to the next station which is not shown in FIG. 4.

The magazine 2' of FIG. 4 is constructed and assembled in such a way that it shields the sheets 17 of the stack 3 against light in the surrounding area. To this end, the upper (actually the left-hand) wall 47*a* of the magazine 2' extends all the way to the roller 48 but is suitably bent to define an opening 49 wherein the lower portions of successive outermost sheets 17 can be flexed in response to rotation of the roller 48 in a counterclockwise direction. The curvature (configuration) of the wall 47*a* can be changed so that it more closely conforms to the outer side of the flexed lower portion 17' of the outermost sheet 17. All that counts is that the opening 49 can communicate with a space (between the inner side of the wall 47*a* and the stack 3 in the magazine 2') which is large enough to allow for proper flexing of the lower portion of the outermost sheet 17 during movement of the slot 48*b* from the solid-line position to the position 48*b'*. The roller 48 is rotated clockwise when the outermost sheet 17 descends beyond the slot 48*b*. The reference characters 48*a* and 48*f* respectively denote the flat and the projection or tooth of the singularizing roller 48.

Figure 5:
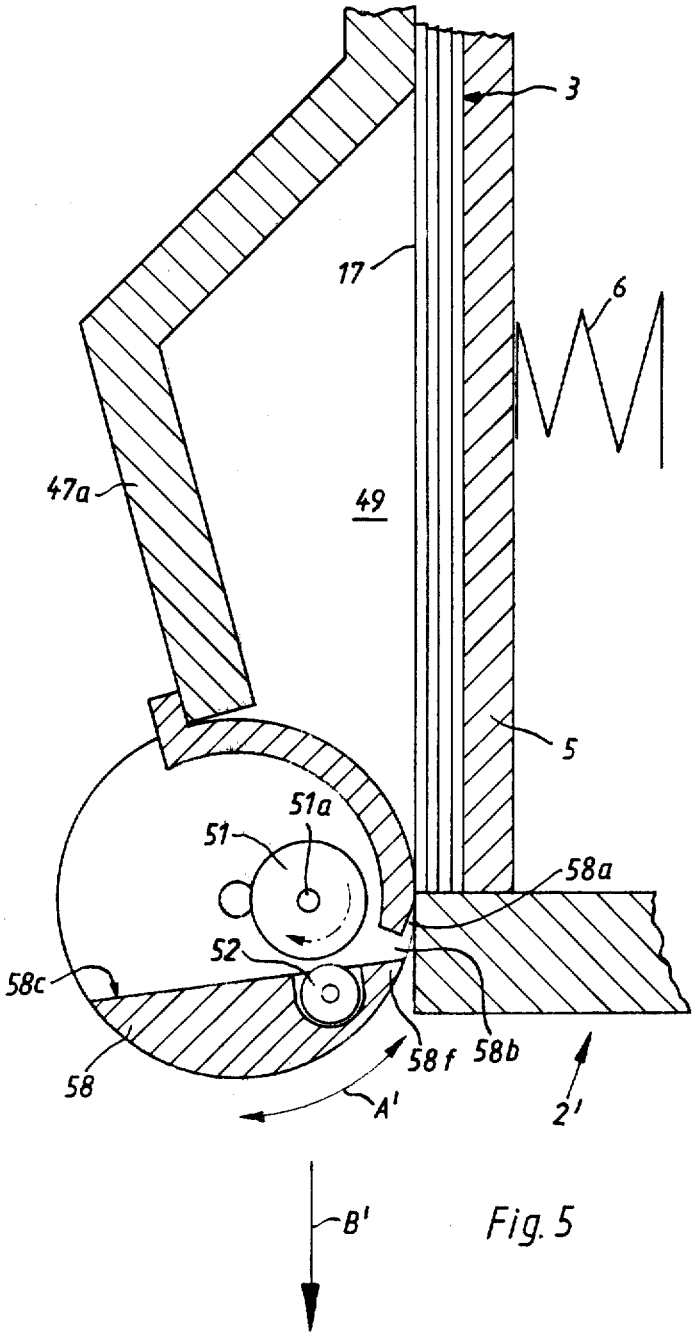
FIG. 5 is a similar fragmentary sectional view of a third singularizing apparatus.

The apparatus of FIG. 5 is similar to the apparatus of FIG. 4. The roller 48 of FIG. 4 is replaced by a modified singularizing roller 58 which is formed with an enlarged recess or slot 58*b* and accommodates an advancing mechanism including rolls 51, 52 at least one of which is driven not later than when an internal surface or shoulder 58*c* in the slot 58*b* moves to a position of substantial parallelism with the pressure plate 5. The lower edge portion of the outermost sheet 17 then snaps into the nip of the rolls 51, 52 and is positively advanced in the desired direction (arrow B'). The manner in which the roll 51 and/or 52 is driven, at least in certain angular positions of the singularizing roller 58, is not specifically shown in the drawing. For example, the drive shaft 51*a* for the roller 51 can carry a gear or friction wheel (not shown) which moves into engagement with a continuously driven friction wheel or gear when the roller 58 completes a certain angular movement in a counterclockwise direction, as viewed in FIG. 5, i.e., when the flexed lower portion of the outermost sheet 17 enters the slot 58*b*.

In view of the provision of advancing rolls 51, 52, the apparatus of FIG. 5 can be used to transport successive outermost sheets 17 in any desired direction, i.e., the orientation of the magazine 2' of FIG. 5 can be changed at will without affecting the singularizing operation. The wall 47*a* seals the opening 49 against entry of light into the magazine 2' and also serves as a stop to terminate the clockwise angular movement of the roller 58. The flat of the roller 58 is shown at 58*a*, and the projection or tooth of this roller is shown at 58*f*.

Figure 6:
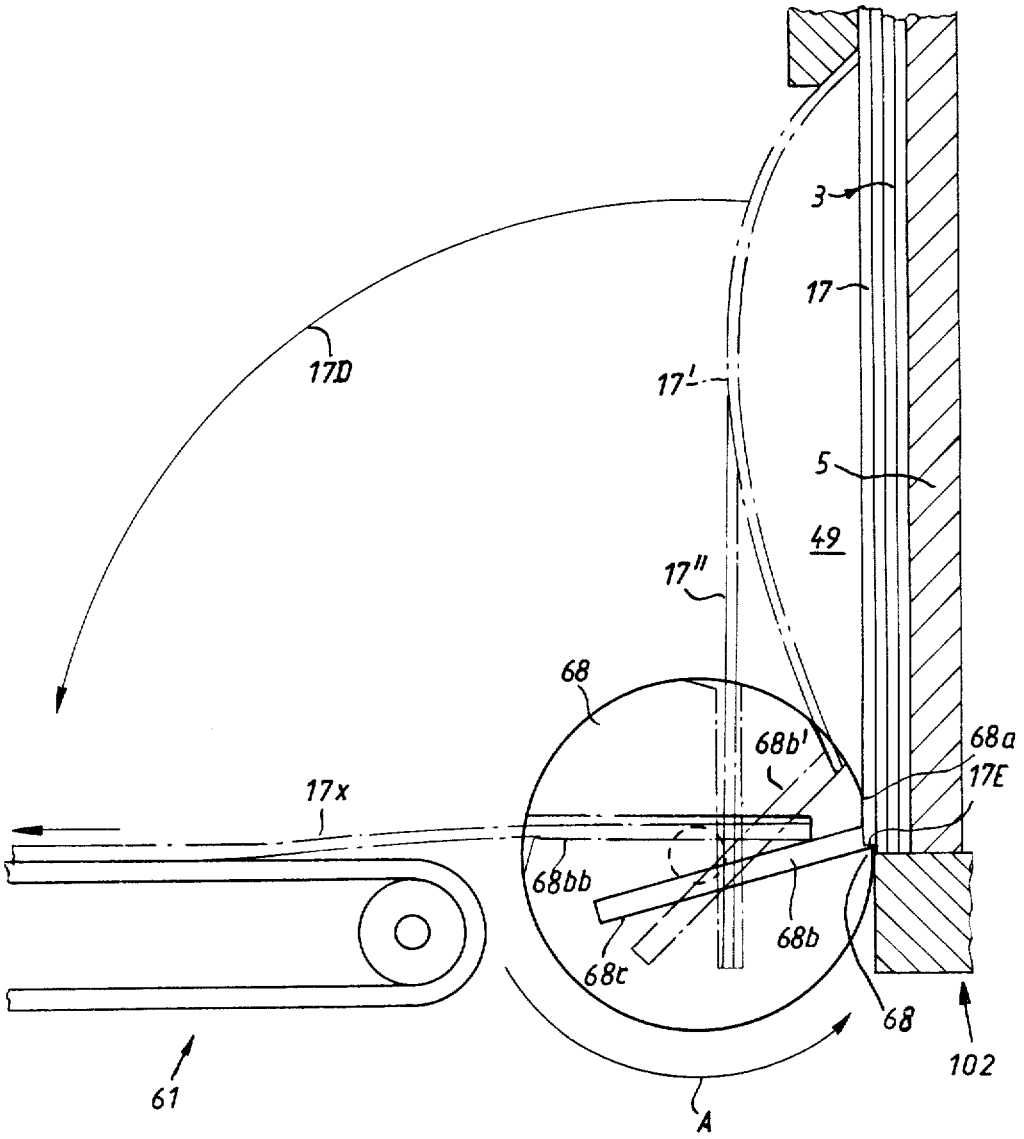
FIG. 6 is a fragmentary sectional view of a fourth singularizing apparatus which automatically changes the orientation of successively removed outermost sheets.

FIG. 6 shows a singularizing apparatus which automatically changes the orientation of successive outermost sheets 17 during removal from the receptacle or magazine 102. The recess or slot 68*b* of the singularizing roller 68 is similar to the slot 48*b* of the roller 48 except that it does not extend through the entire roller 68. In other words, the slot 68*b* constitutes a pocket which receives the lower edge portion of the outermost sheet 17 when the roller 68 is rotated counterclockwise (arrow A) to move the slot 68*b* to the position 68*b'* in which the surfaces flanking the slot 68*b* are parallel to the sheets 17 of the stack 3. The pressure plate 5 is retracted not later than when the outermost sheet 17 assumes the position 17'' so that, as the roller 68 continues to rotate in a counterclockwise direction, the outermost sheet 17 is fully withdrawn from the magazine 2 and is pivoted (see the arrow 17D) to come to rest on the upper reach of a horizontal belt conveyor 61 serving to transport successive sheets 17 to the next station, e.g., into the interelectrode gap of an imaging chamber or into the range of the source of X-rays in an X-ray apparatus, not shown. It is clear that the reoriented sheets 17 can reach the conveyor 61 or an analogous conveyor after a pivotal movement through an angle of less than or in excess of 90 degrees. The apparatus of FIG. 6 is especially suited for singularization of relatively short sheets or for singularization of relatively stiff sheets which do not undergo excessive flexing during pivoting by the roller 68. The conveyor 61 is preferably mounted in the frame (not shown) of the singularizing apparatus. The flat at the periphery of the roller 68 is shown at 68*a*; this flat is located immediately ahead of the open end of the pocket 68*b* so that it enables the outermost portion (shoulder) of the internal surface 68*c* (i.e., the projection or tooth 68*f*) to engage the lower edge face 17E of the outermost sheet 17 while the roller 68 rotates in a counterclockwise direction, as viewed in FIG. 6. The direction of rotation of this roller need not be reversed, i.e., the roller 68 can rotate counterclockwise, either intermittently or without interruptions.

The extent of flexure of the outermost sheet 17 in the intermediate position 68*b''* of the pocket 68*b* is shown at 17'. The reoriented position of the freshly removed sheet 17 is shown at 17*x*. The pocket 68*b* then assumes the position 68*bb*.

Figures 7, 8:
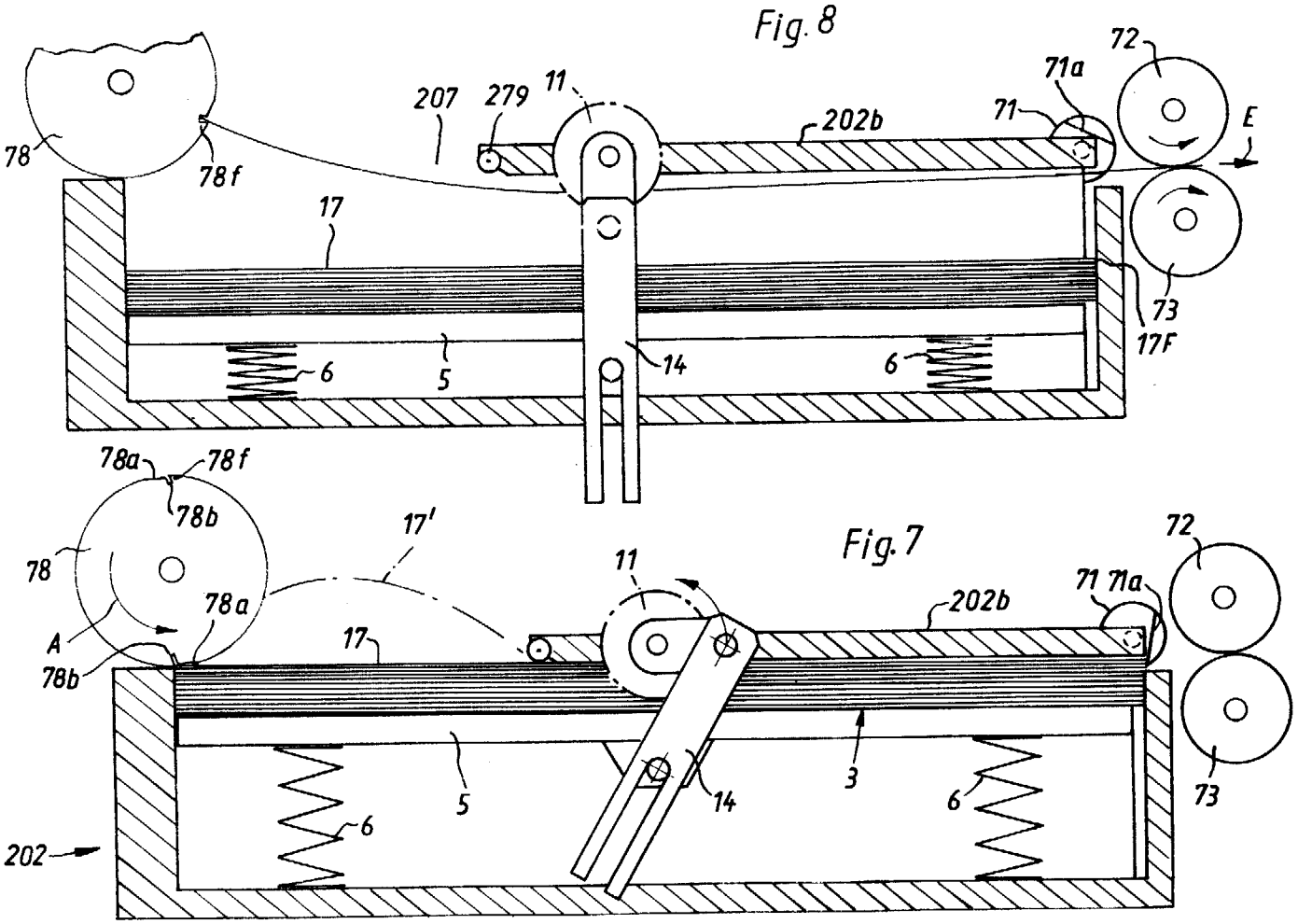
FIG. 7 is a longitudinal sectional view of a fifth singularizing apparatus, with the outermost sheet of the stack shown during the initial stage of separation from the adjacent sheet.
FIG. 8 illustrates the apparatus of FIG. 7, with the outermost sheet shown during a further stage of withdrawal from the stack.

The singularizing apparatus of FIGS. 7 and 8 constitutes a modification of the apparatus of FIG. 1. The main difference is that successive outermost sheets 17 are transported forwardly, i.e., in a direction away from the singularizing roller 78 which corresponds to the roller 8 and has two flats 78*a*, two projections 78*f* and two notches 78*b* disposed diametrically opposite each other. The right-hand end of the magazine 202 carries a rotary moving device 71 for a stop shoulder 71*a* which extends into the path of movement of the front edge face 17F of the outermost sheet 17 when the pressure plate 5 is held in the upper end position of FIG. 7. The roller 78 is driven to rotate in a counterclockwise direction (arrow A) so that one of its flats 78*a* slides along the rear edge portion of the outer side of the outermost sheet 17 and such rear edge portion then enters the oncoming notch 78*b*. This causes the left-hand portion of the outermost sheet 17 to flex and to assume the position 17'. The mechanism including the wheel 11 thereupon lowers the pressure plate 5 to the position of FIG. 8, and the device 71 is rotated to move the stop shoulder 71*a* away from the front edge face 17F of the outermost sheet 17. The rotating roller 78 thereby propels the outermost sheet 17 in the direction of arrow E (whereby the bulge at 17' disappears) and the outermost sheet enters the nip of two advancing rolls 72, 73 which transport such sheet to a processing station, not shown. The distance between the nip of the advancing rolls 72, 73 and the right-hand side face of the stack 3 in the receptacle or magazine 202 is less than the extent of rightward movement of the outermost sheet 17 in response to lowering of the pressure plate 5 so that the outermost sheet 17 invariably moves into the range of advancing rolls 72, 73 when the trailing edge portion of such sheet extends into one of the notches 78*b* and the roller 78 continues to rotate in the direction of arrow A. The pressure plate 5 is preferably retracted against the opposition of the springs 6 when the notch 78*b* which receives the trailing edge portion of the outermost sheet 17 assumes or is close to the nine o'clock position, as viewed in FIG. 7, i.e., when the left-hand portion of the outermost sheet 17 exhibits a pronounced bulge or is close to undergoing a maximal flexing action. The stiffness of the sheets 17 is sufficient to insure that movement of the pressure plate 5 away from the top wall 202*b* of the magazine 202 invariably results in entry of the front edge portion of the outermost sheet 17 into the nip of the advancing rolls 72 and 73. The opening between the top wall 202*b* and the roller 78 is shown at 207. An idler roll 279 at the left-hand end of the top wall 202*b* prevents frictional engagement between this wall and the outermost sheet 17 when the latter advances in the direction of the arrow E.

It goes without saying that the magazine 202 can also comprise means for shielding the sheets 17 of the stack 3 from the surrounding light.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. In an apparatus for removing successive outermost sheets of a stack of overlapping sheets each of which has front and rear edge faces and wherein the outermost sheet has an outer side facing away from the neighboring sheet of the stack, the combination of an abutment for that part of the outer side of the outermost sheet which is adjacent to one edge face thereof; means for biasing the stack toward said abutment to thereby locate the outermost sheet in a predetermined plane; a rotary singularizing member including a substantially horizontal roller having a periphery provided with at least one elongated recess extending into said roller and delimiting a projection movable along an elongated path having a first section into which the other edge face of the outermost sheet in said plane extends and a second section nearer to said abutment than said first section, said recess having such dimensions as to receive and confine that end part of the outermost sheet which is adjacent to said other edge face of the latter for joint movement with said roller at least through said first and second sections of said path, said roller periphery having a flat located ahead of said projection, as considered in the direction of rotation of said roller, said recess being between said flat and said projection; means for rotating said singularizing member in a direction to move said projection along said first section into engagement with the other edge face of the outermost sheet and thereupon along said second section to thereby flex away from the neighboring sheet that portion of the outermost sheet which is disposed between said end part confined in said recess and said abutment; and means for retracting said biasing means in a direction away from said abutment to thereby relax the pressure between said part of the outer side of the outermost sheet and said abutment in flexed condition of said portion of the outermost sheet so that the outermost sheet can be removed from the stack without any or with negligible friction between the outermost sheet on the one hand and the neighboring sheet and said abutment on the other hand.

2. The combination of claim 1, further comprising a receptacle for the stack.

3. The combination of claim 2, wherein said receptacle includes a wall which constitutes said abutment.

4. The combination of claim 2, wherein said biasing means comprises a pressure plate movable in said receptacle in directions at right angles to said plane.

5. The combination of claim 2, wherein said receptacle has an opening intermediate said abutment and said singularizing member.

6. The combination of claim 1, further comprising stop means for said one edge face of the outermost sheet in said plane.

7. The combination of claim 1, said roller and said abutment being spaced apart from each other by a distance at least equal to the diameter of said roller and defining an opening which is adjacent to said plane and has a width at least equal to the length of said edge faces so as to permit unobstructed flexing of said portion of the outermost sheet into said opening.

8. The combination of claim 1, further comprising means for operating said retracting means in synchronism with movements of said singularizing member.

9. The combination of claim 1, wherein said recess is parallel to the axis of said roller and to the edge faces of the outermost sheet.

10. The combination of claim 9, wherein the difference between the radius of said roller and the distance from said flat to the axis of said roller at most equals the thickness of a sheet.

11. The combination of claim 1, wherein said biasing means comprises a pressure plate and said retracting means comprises a rotary crank arm coupled to said plate and means for rotating said crank arm in response to rotation of said singularizing member.

12. The combination of claim 1, further comprising advancing means adjacent to said projection of said singularizing member and operative to engage the flexed portion of the outermost sheet in the region of said other edge face to withdraw the outermost sheet from the stack in retracted position of said biasing means.

13. The combination of claim 1, further comprising means for supporting said stack in upright position so that the other edge face of the outermost sheet is located at a level below the one edge face.

14. The combination of claim 1, further comprising means for shielding the sheets of the stack from light.

15. The combination of claim 1, wherein said recess has such a depth as considered in relation to the stiffness of the respective sheet the end part of which is confined therein that the latter causes the entire sheet to share in the angular displacement of said roller upon relaxation of pressure between said abutment and the respective sheet, said member being rotatable in said direction through an angle which is large enough to change the orientation of the respective sheet while the one edge face of such sheet extends into said recess.

16. The combination of claim 1, for removing relatively stiff sheets, further comprising a stop for the one edge face of the outermost sheet in said plane, means for moving said stop away from said one edge face while said portion of the outermost sheet is flexed by said projection whereby the flexed sheet is propelled beyond the one edge face of the neighboring sheet on retraction of said biasing means as a result of the tendency of the flexed portion to return into said plane, and advancing means operative to engage the thus propelled outermost sheet and entrain the same for movement away from said member.

17. In an apparatus for removing successive outermost sheets of a stack of overlapping sheets each of which has front and rear edge faces and wherein the outermost sheet has an outer side facing away from the neighboring sheet of the stack, the combination of means for supporting said stack in upright position so that one edge face of the outermost sheet is located at a level above the other edge face; an abutment for that part of the outer side of the outermost sheet which is adjacent to said one edge face thereof; means for biasing the stack toward said abutment to thereby locate the outermost sheet in a predetermined plane; a rotary singularizing member including a substantially horizontal roller having at least one projection movable along an elongated path having a first section into which the other edge face of the outermost sheet in said plane extends and a second section nearer to said abutment than said first section, and a slot including an inlet located ahead of said projection to receive the one edge face of the flexed outermost sheet, said slot being located in a substantially vertical plane on completion of movement of said singularizing member along said second section of said path so that the outermost sheet can descend through said slot by gravity; means for rotating said singularizing member in a direction to move said projection along said first section into engagement with the other edge face of the outermost sheet and thereupon along said second section to thereby flex away from the neighboring sheet that portion of the outermost sheet which is disposed between said projection and said abutment; and means for retracting said biasing means in a direction away from said abutment to thereby relax the pressure between said part of the outer side of the outermost sheet and said abutment in flexed condition of said portion of the outermost sheet so that the outermost sheet can be removed from the stack without any or with negligible friction between the outermost sheet on the one hand and the neighboring sheet and said abutment on the other hand.

18. The combination of claim 17, wherein said roller has a peripheral flat located ahead of said inlet, as considered in the direction of rotation of said singularizing member, said flat and said slot having a length, as considered in the axial direction of said roller, which at least equals the length of said edge faces.

* * * * *